United States Patent [19]

Grosse et al.

[11] Patent Number: 4,565,590

[45] Date of Patent: Jan. 21, 1986

[54] SILVER AND METAL OXIDES ELECTRICAL CONTACT MATERIAL AND METHOD FOR MAKING ELECTRICAL CONTACTS

[75] Inventors: Joachim Grosse, Erlangen; Güenter Tiefel, Fuerth; Wolfgang Haufe, Hessdorf, all of Fed. Rep. of Germany

[73] Assignee: Siemens Aktiengesellschaft, Berlin and Munich

[21] Appl. No.: 693,717

[22] Filed: Jan. 23, 1985

[30] Foreign Application Priority Data

Jan. 30, 1984 [DE] Fed. Rep. of Germany ..... 3403115
Jul. 30, 1984 [DE] Fed. Rep. of Germany ..... 3428070

[51] Int. Cl.[4] ..... C22C 1/05; C22C 5/06; C22C 32/00; H01H 1/02

[52] U.S. Cl. ..... 148/431; 75/234; 75/252; 252/512; 252/514; 252/515; 419/21; 420/501; 420/502

[58] Field of Search ..... 420/501, 502; 75/234, 75/252; 419/21; 148/431; 252/512, 514, 515

[56] References Cited

U.S. PATENT DOCUMENTS

| | | | |
|---|---|---|---|
| 3,954,459 | 5/1976 | Schreiner | 75/206 |
| 3,992,199 | 2/1979 | Neely | 75/200 |
| 4,141,727 | 2/1979 | Shida | 75/232 |
| 4,246,321 | 1/1981 | Shibata | 428/614 |
| 4,294,616 | 10/1981 | Kim | 75/234 |
| 4,330,330 | 5/1982 | Bohm | 148/430 |
| 4,341,556 | 7/1982 | Bohm | 75/173 A |
| 4,361,033 | 11/1982 | Kim | 73/64.4 |
| 4,410,491 | 10/1983 | Bohm | 420/501 |
| 4,462,841 | 7/1984 | Miyakawa | 148/431 |

FOREIGN PATENT DOCUMENTS

| | | | |
|---|---|---|---|
| 80641 | 6/1983 | European Pat. Off. . | |
| 52-22767 | 2/1977 | Japan | 420/501 |
| 55-30577 | 8/1980 | Japan . | |
| 58-27904 | 2/1983 | Japan . | |
| 58-96835 | 6/1983 | Japan . | |
| 58-117844 | 7/1983 | Japan . | |
| 59-06342 | 1/1984 | Japan . | |

*Primary Examiner*—Dennis L. Albrecht
*Attorney, Agent, or Firm*—Mark H. Jay

[57] ABSTRACT

The invention relates to a material for electrical contacts, in particular for contact studs in low-voltage switchgear. The material consists of silver, tin oxide and other additives. A material is sought where the overtemperature is lowered as compared with known Ag-$SnO_2$ material. According to the invention, the further additives are in combination oxides of the metals tantalum ($Ta_2O_5$), copper (CuO) and bismuth ($Bi_2O_3$). Further the material may contain also tungsten or oxygen containing tungsten compounds. Preferably the material contains 5 to 20 mass % $SnO_2$, 0.1 to 5 mass % $Ta_2O_5$ 5 mass % CuO, 0.1 to 5 mass % $Bi_2O_3$, optionally 0.05 to 3 mass % tungsten and silver as balance. In the method for producing contact studs, the powder metallurgical production of the material is followed by extrusion to a ribbon, from which contact studs can be separated which have an edge-parallel directional structure.

18 Claims, No Drawings

SILVER AND METAL OXIDES ELECTRICAL CONTACT MATERIAL AND METHOD FOR MAKING ELECTRICAL CONTACTS

BACKGROUND OF THE INVENTION

The invention relates to electrical contacts for use in low-voltage switchgear, the contacts being of the type which is based on silver, tin oxide and other additives. The invention relates also to a method for making contacts from this material, as well as to the contacts so made.

For low-voltage power switchgear, e.g. in contactors or automatic switches, contact materials based on silver metal oxides (AgMeO), in particular AgCdO, have proved advantageous. Since cadmium is known to be toxic and since CdO is given off during burnoff of the contact studs, it has been sought to replace the CdO by other metal oxides. These alternate materials should have the same advantageous characteristics as known AgCdO material, i.e. should have equally little arc burnoff, low welding load, and, in particular only slight heating under continuous current conduction.

Cadmium has been replaced by tin or zinc. However, $AgSnO_2$ and AgZnO contact materials do not, on the whole, match the high-grade properties of AgCdO contact studs. In particular, when $AgSnO_2$ is used as an alternative material for AgCdO it is found that, because of the higher thermal stability of $SnO_2$, $AgSnO_2$ has a higher transition resistance after switching load than does AgCdO, due to formation of oxide cover layers. This then causes contact studs to overheat switchgear, which may cause damage. On the other hand, $AgSnO_2$ contacts have less burnoff than do AgCdO contacts, resulting in longer contact life. For this reason the size of the needed contact studs can advantageously be reduced by comparison with AgCdO, whereby a considerable saving of silver is achieved.

U.S. Pat. No. 4,330,330 describes a $AgSnO_2$-based material in which by addition of tungsten trioxide ($WO_3$) the overtemperature is lowered as compared with pure $AgSnO_2$; in addition, U.S. Pat. No. 4,341,556 proposes as a further additive bismuth oxide ($Bi_2O_3$), which is said to improve the welding load without increasing the contact resistance.

U.S. Pat. No. 4,410,491 states that these overtemperatures can also be improved by adding molybdenum oxide ($MoO_3$) and/or germanium oxide ($GeO_2$). However the addition of $MoO_3$ impairs the burnoff properties of $AgSnO_2$ to such an extent that the life of the contacts is reduced far below that of AgCdO. While these disadvantages do not occur with the use of $GeO_2$, the contact stud becomes more expensive because the price of germanium oxide is a multiple of the price of silver. This largely eliminates the economic advantage of the use of $AgSnO_2$, namely a saving of silver because of the favorable burnoff properties as compared with AgCdO.

One object of the invention is therefore to develop an electrical contact material based on silver and tin oxide in which, by admixture of further additives, overtemperature is lowered as compared with the known $AgSnO_2$ material without reducing the life of the contact or excessively increasing the cost of the material.

SUMMARY OF THE INVENTION

In accordance with the invention, the additives to a silver and tin oxide based material are, in combination, oxides of the metals tantalum ($Ta_2O_5$), copper (CuO) and bismuth ($Bi_2O_3$). Optionally tungsten or oxygen-containing tungsten compounds may be present as well.

In preferred embodiment the new material contains 5% to 20% $SnO_2$ by mass, 0.1% to 5% $Ta_2O_5$ by mass, 0.1% to 5% CuO by mass, 0.1% to 5% $Bi_2O_3$ by mass, with the balance being silver. If tungsten is present, its mass percentage is 0.05 to 3.

A preferred embodiment demonstrates the advantageous property of tantalum oxide in connection with given quantities of CuO, $Bi_2O_3$ and optionally tungsten in contact materials based on silver and tin oxide. WO-Al-80/01434 indicates the use of tantalum oxide in contact materials. In the prior art, however, the tantalum is used either as cadmium tantalum oxide or as tantalum oxide in connection with at least germanium. Because of the favorable wetting properties of tantalum oxide, in the material there used the contact burnoff is improved. What has not been realized until now is that tantalum oxide can be used as an additive in contact materials which are based on silver and tin oxide.

With the invention, materials have now been found which have at least the same service life as an AgCdO material and approximately the same service life as an $AgSnO_2$ material with $WO_3$ additive. But surprisingly the overtemperature in the new material is lower by 7 to 23% than in material containing 11.5% by mass of $AgSnO_2$ and 0.5% by mass of $WO_3$, the welding load values being comparable to those of known AgCdO materials. Depending on the application or type of switchgear, it is now possible to use an optimized material having a low overtemperature and yet sufficient service life.

The materials according to the invention can be produced by known powder-metallurgical methods. For example, for making contact studs the material is subjected, after sintering, to extrusion to a ribbon. Contact studs cut from this ribbon can be brazed onto the contact-holders of conventional switchgear.

DETAILED DESCRIPTION OF PREFERRED EMBODIMENTS

Preferred embodiments of the invention will be explained specifically with reference to the following examples:

EXAMPLE 1

As starting materials are used powders of the components Ag, $SnO_2$, $Ta_2O_5$, CuO and $Bi_2O_3$, a composition in mass percentages of 91.4% Ag, 7.5% $SnO_2$, 0.5% $Ta_2O_5$, 0.3% CuO and 0.3% $Bi_2O_3$ being chosen.

The powder batch is mixed and then subjected to powder-metallurgical process steps of pressing, sintering and repressing at normal pressures and temperatures. Suitable values have been found to be, for example, 200 MPa for the pressing of the powder, 850°–900° C. for one hour in air for the sintering, and 600 MPa for the repressing. From the blank a ribbon is produced to form a semi-finished product by extruding at 700° C., from which contact studs with an edge-parallel directional structure can be separated.

The contact studs thus produced can be brazed directly onto the contact-holders of conventional switchgear.

EXAMPLE 2

Powders of the components as in Example 1 are used, a composition in mass percentages of 87.7% Ag, 10.5% $SnO_2$, 0.8% $Ta_2O_5$, 0.5% CuO and 0.5% $Bi_2O_3$ being chosen. The further manufacturing steps correspond to those of Example 1.

EXAMPLE 3

As starting materials are used again powders of the components Ag, $SnO_2$, $Ta_2O_5$, CuO, $Bi_2O_3$ and additionally powder of pure tungsten. As an example, a mixture with mass percentages of 91.7% Ag, 7.0% $SnO_2$, 0.5% $Ta_2O_5$, 0.3% $Bi_2O_3$ and 0.2% W is chosen. The powder batch is mixed and subsequently subjected to the usual powder-metallurgical process steps of pressing, sintering and repressing. From the blank a ribbon is produced by extruding to form a semi-finished product, from which contact studs with edge-parallel directional structure can be separated.

EXAMPLE 4

Powders of the components as in Example 3 are used, now choosing a composition having mass percentages of 87.5% Ag, 10.5% $SnO_2$, 0.8% $Ta_2O_5$, 0.5% CuO, 0.4% $Bi_2O_3$ and 0.3% W.

Contact studs made from these materials were brazed onto the contact-holders of conventional switchgear.

The contact studs were connected until the original switching surface was remelted everywhere by arc action. This required several thousand switching cycles. Under the highest continuous current load permissible for the switchgear, the temperature at the movable switch element was measured just below the contact studs. It was found that the influence of the contact material could best be determined at this point.

The above described materials were compared, firstly, with AgCdO 12% by mass material and additive-free $AgSnO_2$ material, and secondly, with the $AgSnO_2$ 11.5% by mass $WO_3$0.5% by mass material known from U.S. Pat. No. 4,330,330, which had been prepared by the method described there. The results are compiled in Table 1. Also shown for the individual materials are the maximum terminal overtemperatures which come about through the overtemperature at the switching element, as well as the AC 4 service life.

TABLE 1

| MATERIAL (ADDITIVES EXPRESSED IN PERCENT BY MASS) | MAXIMUM TERMINAL OVERTEMPERATURE (FROM AT LEAST 20 MEASUREMENTS) IN K | APPROXIMATE SERVICE LIFE (IN NUMBER OF SWITCHING CYCLES) PER AC 4 | MATERIAL |
|---|---|---|---|
| AgCdO 12 | 66 | 50,000 | COMPARISON MATERIAL |
| $AgSnO_2$ 8 | 100 | 78,000* | COMPARISON MATERIAL |
| $AgSnO_2$ 12 | 100 | 85,000* | COMPARISON MATERIAL |
| $AgSnO_2$ 11.5 $WO_3$ 0.5 | 88 | 95,000* | COMPARISON MATERIAL |
| $AgSnO_2$ 7.5 $Ta_2O_5$ 0.5 CuO 0.3 $Bi_2O_3$ 0.5 | 68 | 70,000* | EXAMPLE 1 |
| $AgSnO_2$ 10.5 $Ta_2O_5$ 0.8 CuO 0.5 $Bi_2O_3$ 0.5 | 76 | 85,000* | EXAMPLE 2 |
| $AgSnO_2$ 7 $Ta_2O_5$ 0.5 CuO 0.3 $Bi_2O_3$ 0.3 W 0.2 | 74 | 100,000* | EXAMPLE 3 |
| $AgSnO_2$ 10.5 $Ta_2O_5$ 0.8 CuO 0.5 $Bi_2O_3$ 0.4 W 0.3 | 82 | 115,000* | EXAMPLE 4 |

*Contact stud volume approximately 20% below that for AgCd.

As can be seen from Table 1, the overtemperatures measured at the terminals are higher for the comparison material $AgSnO_2$ 11.5% $WO_3$ 0.5% by 33% than for AgCdO 12%, while the pure $AgSnO_2$ materials are higher by more than 44%. It is found that the materials according to the preferred embodiments show overtemperatures which are between 7 and 23% lower than those of the comparison material $AgSnO_2$ 11.5 $WO_3$ 0.5 and thus in the most favorable case come up to the temperatures of AgCdO.

From the direct comparison with $AgSnO_2$ 12% and $AgSnO_2$ 8%, respectively, referred to comparable total oxide content, the temperature-lowering action of the additives of the preferred embodiments can be seen. The materials according to the invention with low oxide content (as well as those without tungsten additive tend to have a somewhat lower overtemperature. From the service life figures it can be seen that all $AgSnO_2$ materials reach a switching number higher by about 20% as compared with AgCdO 12% despite the reduction in volume of the stud. The materials according to the invention with tungsten additive are even above the comparison material $AgSnO_2$ 11.5% $WO_3$ 0.5%, while the materials of the invention without tungsten reach comparable switching numbers as the corresponding pure $AgSnO_2$ materials, but exhibit the most favorable overtemperature behavior of all examined $AgSnO_2$ materials (at equal oxide content).

While tests with tungsten containing $AgSnO_2$ contact materials confirm in various switchgear the favorable service life in general, in certain AC switchgear, however, material displacements may occur which lead to premature failure of the switchgear. Contact material is in such cases transferred from one switching element to the opposite one, so that the material-yielding switching element limits the life of the switchgear by through-switching to the support material before the expected switching number is reached. The causes of this material displacement are not yet known, but seem to be connected with the addition of tungsten or oxygen-containing tungsten compounds, as such displacement has not occurred so far in tungsten-free $AgSnO_2$ materials. For these reasons, first the behavior with respect to material displacement must be tested before the tungsten-containing $AgSnO_2$ materials are employed. Alternatively, if material displacement occurs, the tungsten-free material according to the invention can be employed as a replacement for AgCdO, which at a volume reduction by about 20% still shows a favorable burnoff behavior as compared with AgCdO.

In all, the materials of the preferred embodiments with tungsten additive have a long life than $AgSnO_2$ 11.5% $WO_3$ 0.5% combined with lower overtemperature, while the materials of the preferred embodiments without tungsten excel through absence of material displacement, very favorable overtemperature and, compared with AgCdO, longer life, although the latter does not quite reach the values of $AgSnO_2$ 11.5% $WO_3$ 0.5%.

It can, therefore, be documented that the averages of the temperatures measured on the materials of the invention are considerably below those for the $AgSnO_2$11.5% $WO_3$0.5% material. This result is the more surprising as the material migrations, previously believed to be inevitable, can now be controlled better. The welding load in all materials showed values in the same order of magnitude as for the AgCdO material used before.

In further examples the composition of the material with the specific oxide combination $SnO_2$, $Ta_2O_5$, CuO and $Bi_2O_3$ and optionally W can be further varied. In particular the mass compositions (besides silver) may be 8 to 14% $SnO_2$, 0.2 to 1.5% $Ta_2O_5$, 0.2 to 1.5% CuO, 0.1% to 1.2% $Bi_2O_3$ and optionally 0.05% to 1% tungsten. Concerning the latter it has been found that the tungsten can be added either as pure tungsten or as tungsten trioxide ($WO_3$) or other oxygen-containing tungsten compounds without detriment to the properties of the contact material.

The surprising appearance of a reduced overtemperature at the contact stud when using tantalum oxide has been found also in materials which contain (besides silver) 5 to 20 mass-% $SnO_2$, 0.1 to 5 mass-% $Ta_2O_5$, 0.1 to 5 mass-% CuO, 0.1 to 5 mass-% $Bi_2O_3$ and optionally 0.05 to 3 mass-% W.

The material costs of the individual additives are only about 40% as compared with $GeO_2$, heretofore found to be especially favorable.

Those skilled in the art will understand that changes can be made in the preferred embodiments here described, and that these embodiments can be used for other purposes. Such changes and uses are within the scope of the invention, which is limited only by the claims which follow.

What is claimed is:

1. A material for electrical contacts, comprising:

5–20 percent by mass $SnO_2$;

0.1–5 percent by mass $Ta_2O_5$;

0.1–5 percent by mass CuO;

0.1–5 percent by mass $Bi_2O_3$; and the balance being substantially silver.

2. The material of claim 1, further comprising an additive selected from a group consisting of tungsten metal and oxygen-containing tungsten compounds.

3. The material of claims 2 or 1, further comprising 0.05 to 3 percent by mass of tungsten.

4. The material of claim 1, wherein there is contained 7 to 14 percent by mass of of $SnO_2$, 0.2 to 1.5 percent by mass of $Ta_2O_3$, 0.2 to 1.5 percent by mass of CuO, and 0.1 to 1.2 percent by mass of $Bi_2O_3$.

5. The material of claim 3, wherein there is 0.05 to 1 percent by mass of tungsten.

6. The material of claim 4, further comprising 0.05 to 1 percent by mass of tungsten.

7. The material of claim 4, wherein there is contained 7.5 percent by mass of $SnO_2$, 0.5 percent by mass of $Ta_2O_5$, 0.3 percent by mass of CuO, 0.3 percent by mass of $Bi_2O_3$, and silver.

8. The material of claim 4, wherein there is contained 10.5 percent by mass of $SnO_2$, 0.8 percent by mass of $Ta_2O_5$, 0.5 percent by mass of CuO, 0.5 percent by mass of $Bi_2O_3$, and silver.

9. The material of claim 3, wherein there is contained 7.0 percent by mass of $SnO_2$, 0.5 percent by mass of $Ta_2O_5$, 0.5 percent by mass of CuO, 0.3 percent by mass of $Bi_2O_3$, 0.2 percent by mass of tungsten, and silver.

10. The material of claim 3, wherein there is contained 10.5 percent by mass of $SnO_2$, 0.8 percent by mass of $Ta_2O_5$, 0.5 percent by mass of CuO, 0.4 percent by mass of $Bi_2O_3$, 0.3 percent by mass of tungsten, and silver.

11. The material of claim 2, wherein the oxygen-containing tungsten compound is an oxide.

12. The material of claim 11, wherein the oxide is $WO_3$.

13. A method for making electrical contact studs, comprising: processing the material of claim 1 in powder form; pressing the material; sintering the material; repressing the material; and producing the material in a ribbon-shaped form.

14. The method of claim 13, further comprising adding pure tungsten metal in powder form prior to pressing the material.

15. The method of claim 13, further comprising adding tungsten trioxide powder prior to pressing the material.

16. The stud produced by the method of claim 13.

17. The stud of claim 16, wherein the stud has a directional structure.

18. The stud of claim 17, wherein the directional structure is parallel to edges of the stud.

* * * * *